US007498742B2

(12) United States Patent
Janssen et al.

(10) Patent No.: US 7,498,742 B2
(45) Date of Patent: Mar. 3, 2009

(54) HIGH-PRESSURE DISCHARGE LAMP, AND METHOD OF MANUFACTURE THEREOF

(75) Inventors: Marc F. R. Janssen, Kasterlee (BE); Jan A. J. Stoffels, Turnhout (BE); Nicasius G. T. Van Gennip, Heeze (NL); Jean-Sebastien Straetmans, Aachen (DE); Josephus C. M. Hendricx, Geldrop (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 526 days.

(21) Appl. No.: 10/535,642

(22) PCT Filed: Nov. 18, 2003

(86) PCT No.: PCT/IB03/05225

§ 371 (c)(1),
(2), (4) Date: May 20, 2005

(87) PCT Pub. No.: WO2004/049391

PCT Pub. Date: Jun. 10, 2004

(65) Prior Publication Data

US 2006/0008754 A1 Jan. 12, 2006

(30) Foreign Application Priority Data

Nov. 25, 2002 (EP) ..... 02102637

(51) Int. Cl.
*H01J 17/00* (2006.01)

(52) U.S. Cl. ..... 313/567; 313/573; 313/623; 313/634

(58) Field of Classification Search ..... 313/567, 313/627–643, 111–117, 25–27, 318.01–318.09; 439/615, 739; 445/24, 26, 29, 22
See application file for complete search history.

(56) References Cited

U.S. PATENT DOCUMENTS

| | | | | | |
|---|---|---|---|---|---|
| 4,155,757 | A * | 5/1979 | Hing | 75/232 |
| 4,972,119 | A * | 11/1990 | Kariya et al. | 313/624 |
| 4,988,916 | A * | 1/1991 | Odell et al. | 313/623 |
| 5,075,587 | A * | 12/1991 | Pabst et al. | 313/25 |
| 5,404,077 | A * | 4/1995 | Eichelbronner et al. | 313/623 |
| 5,810,635 | A | 9/1998 | Heider et al. | |
| 5,861,714 | A * | 1/1999 | Wei et al. | 313/625 |
| 6,194,832 | B1 | 2/2001 | Juengst | |
| 6,404,129 | B1 * | 6/2002 | Hendricx et al. | 313/620 |
| 6,479,950 | B2 * | 11/2002 | Takahashi et al. | 315/291 |
| 6,495,962 | B2 * | 12/2002 | Uemura et al. | 315/77 |
| 6,650,056 | B2 * | 11/2003 | Kramer | 313/637 |
| 6,774,566 | B2 * | 8/2004 | Honda et al. | 313/634 |
| 2002/0070668 | A1 | 6/2002 | Eastlund et al. | |
| 2003/0076041 | A1 * | 4/2003 | Honda et al. | 313/634 |

FOREIGN PATENT DOCUMENTS

| | | |
|---|---|---|
| EP | 0883160 A1 | 12/1998 |
| EP | 0883160 B1 | 12/1998 |
| EP | 1158567 A2 | 11/2001 |
| EP | 1158567 A3 | 1/2002 |
| WO | WO 00/67294 | 11/2000 |

* cited by examiner

*Primary Examiner*—Sikha Roy
*Assistant Examiner*—Donald L Raleigh

(57) ABSTRACT

A ceramic gas tight high-pressure burner includes an ionizable filling. The burner further includes a discharge vessel having a discharge cavity with a volume in the range of 3 $mm^3$ to 30 $mm^3$, and an internal filling pressure of the discharge cavity in the range from 0.1 MPa to 4 MPa at room temperature. An end closure of the burner may be designed as a three-part, a two-part or a one-part end closure device with a reduced crevice.

12 Claims, 5 Drawing Sheets

HIGH-PRESSURE DISCHARGE LAMP, AND METHOD OF MANUFACTURE THEREOF

Figure 1:
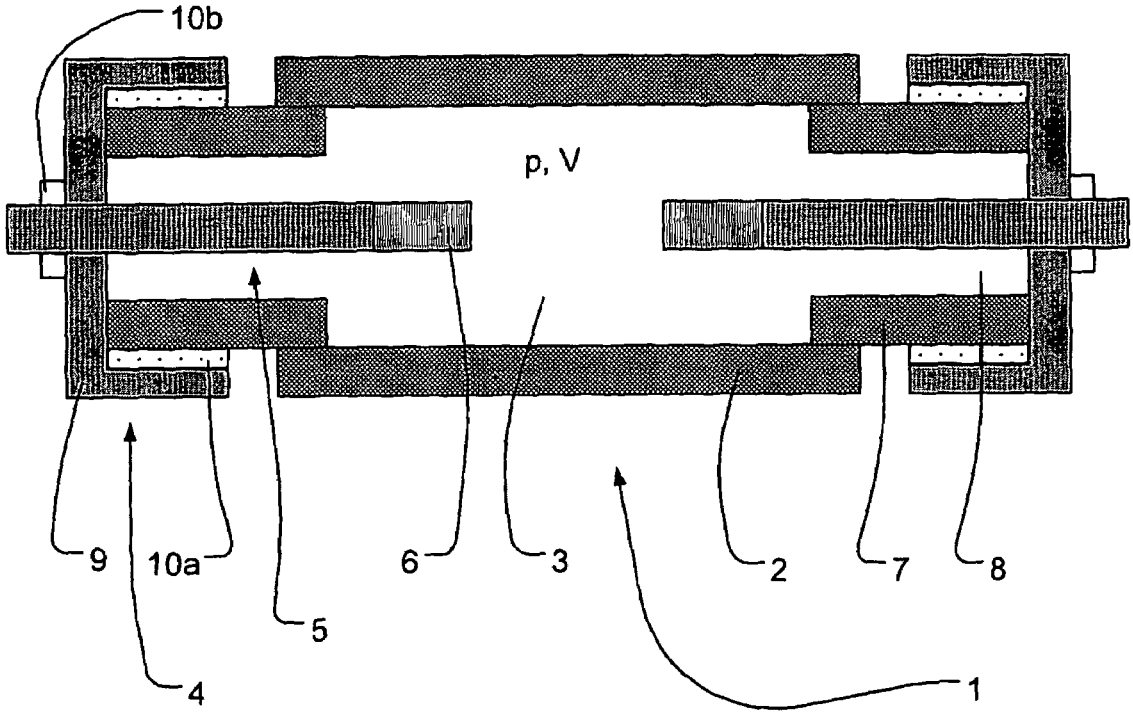

The present invention relates to a high-pressure discharge lamp, such as for instance an automotive lamp used for head lighting applications, comprising a ceramic discharge vessel, which encloses a discharge cavity, having a small volume and a high filling pressure, whereby said filling is preferably ionisable. More precisely, said invention relates to a metal halide lamp comprising a substantially cylindrical discharge vessel having a ceramic wall, which encloses a discharge space characterized by an internal diameter. Said discharge vessel is closed by means of end closure devices, where electrodes are arranged therein, whose tips have a mutual spacing between which a discharge is maintained. Said electrode is connected to an electric current conductor by means of a feed-through element, which protrudes into said end closure device with a tight fit, and is connected thereto in a gas tight manner by help of connection means. Said discharge vessel is filled with an ionisable filling. Said filling comprises inert gas such as for instance Xenon, and ionisable salts. More particularly, said invention relates to a high-pressure burner with a reduced discharge cavity volume, and increased filling gas pressure at room temperature.

High-pressure discharge lamps and related manufacturing processes are known from a prior art. Nevertheless, it is still necessary to provide a manufacturing process of said high-pressure discharge lamps avoiding the drawbacks known from said prior art. Due to said high-pressure filling, gas tight closing said discharge vessel causes several problems. Heating said discharge vessel for gas tight sealing leads said internal filling to expand or evaporate. As a result, filling gas expansion causes a bad quality seal, and filling salts evaporation gives unexpected lamp characteristics. Said seal is then characterized in that it ends up with an irreproducible length, since expanding gas tends to push the seal outwards from said discharge vessel. Moreover said seal will contain defects, such as gas bubbles, leading to cracks, which weakens the seal mechanical strength, leading to leakage.

In order to prevent the expansion or evaporation of said filling, several attempts to find alternative sealing processes and designs have been made.

WO 00/67294 describes a high-pressure discharge lamp, more precisely a metal halide one, with a very small, very high-pressure filled vessel, surrounded by a gas filled outer bulb.

Said lamp has the advantage of having a discharge vessel with very compact dimensions, which makes it highly suitable for head lighting applications in motor vehicles. Thanks to the discharge vessel internal diameter, small compared to the electrode spacing, the discharge arc is sufficiently straight, and its light emitting surface sufficiently sharply limited, so that it can be used as a light source in an automotive headlamp, especially in a headlamp with a complex-shape reflector.

The drawbacks of the known lamp are however a relative loss of the initial filling while heating up said lamp's discharge vessel as gas-tight closing it. It leads to a wrong colour point setting and to colour instability. Drawbacks also comprise an irreproducible initial sealing ceramic length while gas tight closing said discharge vessel, a sealing ceramic cracking behaviour within the high lamp-operating temperature range, which leads to a leaky seal. Furthermore said discharge vessel end construction design comprise a wide clearance, between said feed-through outer surface and the ceramic plug inner wall, which leads to colour instability. These drawbacks are caused by the current sealing process, or are related to the current sealing design. Said process is actually heating far too much surface of said filled discharge vessel, and said design is leaving far too much clearance between said feed-through and said ceramic plug. Both the feed-through and the ceramic plug are furthermore made of inappropriate thermo mechanically matching materials.

U.S. Pat. No. 5,810,635 A1 describes a ceramic discharge vessel for a high-pressure discharge lamp, which comprises a pin-like feed-through inserted into a plug, made from a thermo mechanically matching composite material. The feed-through has been sintered directly into the plug. Additionally, said feed-through has been sealed to the plug, by covering its surrounding area facing away from the discharge vessel with a ceramic sealing material. The main purpose of the invention is to obtain long-time gas tightness, whereby it is firstly ensured by the tight fit of the feed-through sintered into the composite plug, and later ensured by sealing ceramic material facing away from the discharge vessel, as the sintering fit gets loose. The sequencing of the ceramic discharge vessel closure is of a primary importance: first the composite plug with sintered feed-through is sintered to the end of the vessel, and then the filling is performed through a small hole either located into one tubular-shaped feed-through or through a discharge vessel side hole. Eventually the small aperture is closed. This invention is addressing the issues of sealing frit length, clearance between feed-through and ceramic plug, and heating a filled discharge vessel while closing the plug.

It turns out, however, that the end construction design and process mentioned in U.S. Pat. No. 5,810,635 A1 has two major drawbacks. Firstly, the use of a tubular-shaped feed-through design, or a side-pierced discharge vessel design, through which the filling could be introduced to the discharge cavity, is very difficult in a very small and compact burner. Moreover, a tubular feed through design is very difficult as one of its parts is usually made of a thin composite material such as cermet. Consequently, the proposed process sequencing related to the described lamp manufacture, that is to say closing the discharge vessel first and then filling it, cannot be applied for very compact burners.

The lamp previously mentioned has the disadvantage that its internal gas filling pressure is still too low and its volume is still too high for an automotive application.

In a first aspect of the present invention, a ceramic gas tight high-pressure burner is described, which has a discharge cavity with a small volume and a high internal gas filling pressure. Said described burner overcomes the drawbacks known from a prior art that have been summarized above, and said burner has furthermore an improved corrosion resistance.

A second aspect of the present invention is to provide a lamp comprising a ceramic gas tight high-pressure discharge vessel.

A third object of the present invention is to provide a manufacturing process of said ceramic gas tight high-pressure burner that can be implemented in mass production.

A ceramic gas tight high-pressure burner is characterized in that it comprises an ionisable filling with a specific pressure, which is arranged in a discharge vessel with a specific volume. Said discharge vessel cavity volume lies in a range of 3 $mm^3$ to 30 $mm^3$. Said discharge vessel filling gas pressure is characterized in that it is $\geqq 0.1$ MPa, and preferably lies in the range of 0.5 MPa to 4 MPa at room temperature.

Further miniaturization of said burner design leads the discharge cavity volume, wherein ionisable filling is added, to lie preferably in the range of 3 $mm^3$ to 20 $mm^3$, and most preferably in the range of 3 $mm^3$ to 15 $mm^3$.

Said ionisable filling can comprise Hg or can be completely Hg-free.

By using a mercury-free, ionisable filling, the risk of polluting our environment is reduced.

Introducing Hg as a compound in said ionisable filling enables to use lower internal gas filling pressure than without Hg, at constant volume.

The internal gas filling pressure in the discharge cavity is ≧0.1 MPa, lies preferably in the range of 0.3 MPa to 5.84 MPa at room temperature, preferably in the range of 0.4 MPa to 5 MPa, and most preferably in the range of 0.5 MPa to 4 MPa.

The term "room temperature" used in the description is defined as a temperature of 21° C.

The burner power lies in the range of 5 W to 50 W, preferably in the range of 20 W to 35 W, and most preferably from 22 W to 32 W.

In a preferred embodiment of the present invention a burner comprises at least one end closure device, comprising at least one connection means, gas tight connecting the feed-through to the discharge vessel.

The lamp can comprise at least one end closure device, comprising at least one end closure member, having at least one feed-through-opening, where a feed-through is arranged therein, whereby said end closure member is directly gas tight connected to the discharge vessel, and the feed-through is gas tight connected to the end closure member by connection means.

According to a further embodiment of the present invention, the gas tight high-pressure burner comprises at least one end closure device, comprising at least one end closure member. Said end closure member has at least one feed-through-opening, where a feed-through is arranged therein. Connections means are gas tight connecting the end closure member to the discharge vessel, and connection means are gas tight connecting the feed-through to the end closure member.

A suitable material for the discharge vessel is polycrystalline alumina (PCA), which is substantially made of $Al_2O_3$. This PCA-material has a thermal expansion coefficient of about $8 \cdot 10^{-6}\ K^{-1}$, and is usually not weld-able.

The ceramic gas tight high-pressure burner comprises crevices by design, whereby said crevice can be tubular-shaped and/or has a volume of ≧0 $mm^3$ and ≦1.7 $mm^3$. Preferably said crevice has a volume lying in the range of 0 $mm^3$ to 1.2 $mm^3$, and most preferably the crevice has a volume in the range of 0 $mm^3$ to 0.3 $mm^3$, whereby the crevice has an open end facing the discharge vessel.

According to the present invention, a crevice is the space between the gas tight sealed feed-through, and the part in which said feed-through is arranged and sealed. Another definition of a crevice is the remaining space of the feed-through opening, after the feed-through is arranged into said feed-through opening and gas tight sealed. More precisely, a crevice is the volume remaining from subtracting the feed-through part volume from the feed-through opening volume. From the feed-through opening volume is actually also subtracted the volume of the connection means after the feed-through connecting process.

The crevice shape can be described as tubular like, preferably the centre of the inner protrusion is also the centre of the outer tube. A tubular shape can be determined with several parameters, such as its length. The crevice length is the length resulting from subtracting the length filled by connection means being in the feed-through opening from the length between the feed-through entry opening and the feed-through exit opening. Another parameter is its width. The crevice width is the length resulting from subtracting the radius of the outer surface of the feed-through from radius of the surface of the feed-through opening. The crevice width can be worked out according to the formula:

$$\text{Width}=0.5\times(\text{"diameter of the feed-through-opening"}-\text{"diameter of the feed-through"})$$

The crevice volume can be worked out with the following formula:

$$\text{Volume}=0.25\pi\times((\text{"diameter of the feed-through opening"})^2-(\text{"diameter of the feed-through"})^2)\times(\text{"Length of the protrusion"}).$$

Typical values of the crevice length (L), of the feed-through diameter (Di), and of the feed-through opening diameter (Da) can be taken from the following table:

| L [μm] | Di [μm] | Da [μm] |
|---|---|---|
| 0 . . . 10.000 | ≈500 | ≈540 . . . 580 |

To avoid disadvantages caused by a crevice, its volume should be 0. Preferably, the crevice length (L) should be 0.

Connection means, according to the present invention, are means used for gas tight connecting at least two components of the high-pressure burner. To avoid stress build up and cracks in the materials, it is important for the connection means to have about the same thermal expansion coefficient as the components to be connected. Connection means as introduced in the present invention comprise materials used for welding, laser welding, resistance welding, soldering, brazing, bonding with adhesive materials, primary shaping, sintering, sealing or any combination of the aforementioned materials.

According to one further embodiment, the connection between the discharge vessel and the end closure member can be achieved by pure sintering, i.e. without extra connection means. In this case, the end closure member is shaped as a plug or a cork. This simplifies the manufacturing process and leads to material savings.

However, using connection means without any end closure device, in order to obtain a gas tight burner, simplifies the manufacturing process even more, as well as results in additional material savings.

Connection means for gas tight connecting the feed-through to the end closure member, and/or gas tight connecting the end closure member to the discharge vessel, are selected from a group comprising sealants, welding seams, and/or adhesive materials. By using these materials and processes, a gas tight connection can be achieved.

Connecting a feed-through to an end closure device can be performed at several locations of the end closure device feed-through opening. The further the connection location from the discharge vessel, the bigger the crevice. During lamp operation, ionisable salts can de-mix, and they condensate. Some compounds condensate in the corners of the discharge vessel. Some can migrate towards the burner's coldest spot located in said crevice. These salts then in several places along the crevice and at the lamp coldest spot located at the very extremity of the crevice against the seal, and form a salt pools. Said pools make the lamp colour point instable. Aside this major problem, the salt pool located against the seal tends to corrode it. Indeed the crevice stresses out the temperature gradient within the burner and encourages salts de-mixing, which leads to colour instability. Furthermore, as the salt pools in the crevice tend to corrode the seal, they lead to a shorter burner lifetime. In order to prevent the formation of a crevice, the connection of the feed-through must be ideally located at the innermost feed-through-opening facing the discharge vessel, i.e. at the end opening of the discharge cavity.

Preferably the ceramic gas tight high-pressure burner has an end closure member, said end closure member has at least one through-going feed-through opening, whereby the cross-section of the through-going feed-through opening varies along its symmetry axis.

It has been found that colour stability and corrosion problems, caused by the crevice, can be attenuated or avoided when the outer cross-section of the end closure device feed-through-opening is ≧ than the inner cross-section of the end closure device feed-through-opening. Such a feed-through-opening geometry enables a gas tight connection of the feed-through within the end closure member, located at the innermost feed-through-opening section of the end closure member facing the discharge vessel. The preferred profiles of the feed-through-opening along its symmetry axis are a cone, an ellipsoid, a parabola, a hyperbola, a hemisphere, a T-like profile, and/or combinations thereof.

In a preferred embodiment of the present invention, the feed-through opening is shaped, preferably with a V-like profile, in order to enable a gas tight connection between the end closure member and the feed-through at the innermost end closure member side facing the discharge vessel, i.e. near the electrode, so that basically no crevice is formed.

The feed-through opening cross-section along a surface perpendicular to its main symmetry axis can have any shape. It is preferably a circle, an ellipse, a triangle or a square profile. The inner and the outermost cross-sections can also be congruent or there like.

The end-closure device materials should have a thermal expansion coefficient matching the one of the discharge vessel, so that no stress or crack builds up during the sealing process and the thermal cycles of the operating burner later on. Thus, the end closure device, preferably end closure member and/or connection means, is made of a metal, preferably Mo, a coated metal, preferably Ta coated with Mo or $Al_2O_3$, a metal alloy, preferably an inter-metallic such as $Mo_3Al$, of a cermet, and/or of a ceramic, preferably $Al_2O_3$. Should the end closure device be made of a cermet material, it would preferably be a functionally graded material.

A suitable cermet material used according to the present invention has a substantially continuous gradient of at least compounds A and B, whereby the concentration of material compound A substantially increases in the same degree, in that the concentration of material compound B decreases. The concentration gradient can preferably be described with any linear or non-linear function.

Preferably, the weight ratio of compounds A and B increase, so that one end matches the expansion coefficient of the discharge vessel. For instance, if the discharge vessel were made of $Al_2O_3$, which expansion coefficient is $8\cdot10^{-6}$ $K^{-1}$, one of said compounds would match this coefficient. Should the discharge vessel be made of another material, such as for instance YAG, YbAG or AlN, one of said compounds would be chosen to match its expansion coefficient. The other end must be weld-able.

The cermet material comprising a gradient of at least compounds A and B is characterized in that it has an outer layer, in which the concentration of material compounds A and B are constant. Preferably the weight percent ratio of compounds A and B in the opposed highest and lowest layer set such as the highest layer comprises ≦100% weight-% A and ≧0 weight-% B, and the lowest layer comprises ≦100% weight-% B and ≧0 weight-% A; alternatively the lowest layer comprises ≦100% weight-% A and ≧0 weight-% B and the highest layer comprises ≦100% weight-% B and ≧0 weight-% A.

Said layer can have a thickness from 0 to 500 Jm, preferably from 0 to 50 μm and most preferably from 0 to 5 μm.

The compound A can be $Al_2O_3$ and the compound B can be Mo. Other compounds can be mixed additionally to A and B in the same graded, or in an un-graded, manner.

Materials, which expansion coefficient α(T) matches the expansion coefficient of a polycrystalline alumina discharge vessel of about $8\cdot10^{-6}$ $K^{-1}$ can also be used for the present invention. Such materials are characterized in that their expansion coefficient α(T) lie in the following range: $4\cdot10^{-6}$ $K^{-1}\leqq\alpha(T)\leqq12\cdot10^{-6}$ $K^{-1}$ for temperatures T lying in the following range: 298 K≦T≦2174 K.

The materials used according to the present invention are preferably resistant towards metal halogenide iodides and/or oxides derived from the end closure device and connecting materials.

Advantageously, at least one end part of the discharge vessel is at least partly coated with a layer. Said layer improves the binding of the connection means, whereby the layer provides higher adhesive strength between the discharge vessel and the connection means, and/or between the connection means and the end closure device, compared to the adhesive strength between the discharge vessel and the end closure device.

The layer is preferably at least partly located between the end part of the discharge vessel and the end closure device.

This coating layer is applied onto the discharge vessel in its green state before the firing step of the discharge vessel sintering process. Such a layer provides a stronger gas tight connection between the end closure device and the discharge vessel.

A second aspect of the present invention is to provide a lamp comprising said ceramic gas tight high-pressure burner. The lamp comprising said burner is preferably arranged in a headlamp. Such headlamps are preferably used in the automotive sector, especially in the car industry, but are not limited to this use only.

A third aspect of the present invention is to provide a method of manufacturing a ceramic gas tight high-pressure burner, comprising at least one end closure device, at least two feed-through parts, and at least one discharge vessel, with at least one end opening, whereby said method comprises the following steps:

i) Filling said discharge vessel with an ionisable filling through at least one opening, and ii) Closing said opening by arranging a feed-through therein, followed by gas tight connecting said feed-through to the end closure device and/or to the discharge vessel, whereby a gas tight high-pressure burner is obtained.

The opening is preferably a feed-through opening. By filling the discharge vessel through a feed-through opening, and then gas tight closing the feed-through opening, the thermal influence caused by the connecting process is lower than the thermal impact caused by a comparable closing process of the end closure device onto the end openings of the discharge vessel. Indeed, closing the feed through opening requires a local and very quick heating.

In order to achieve a high internal gas filling pressure, and to reduce the impact of the heating while sealing, it is necessary to minimize the time needed for the closing process, i.e. the sealing process.

Sealing time of the aforementioned processes lies in the range of 0 sec. to 10 sec., preferably 0 sec. to 5 sec, and most preferably 0 to 2.5 sec.

Figure 2:
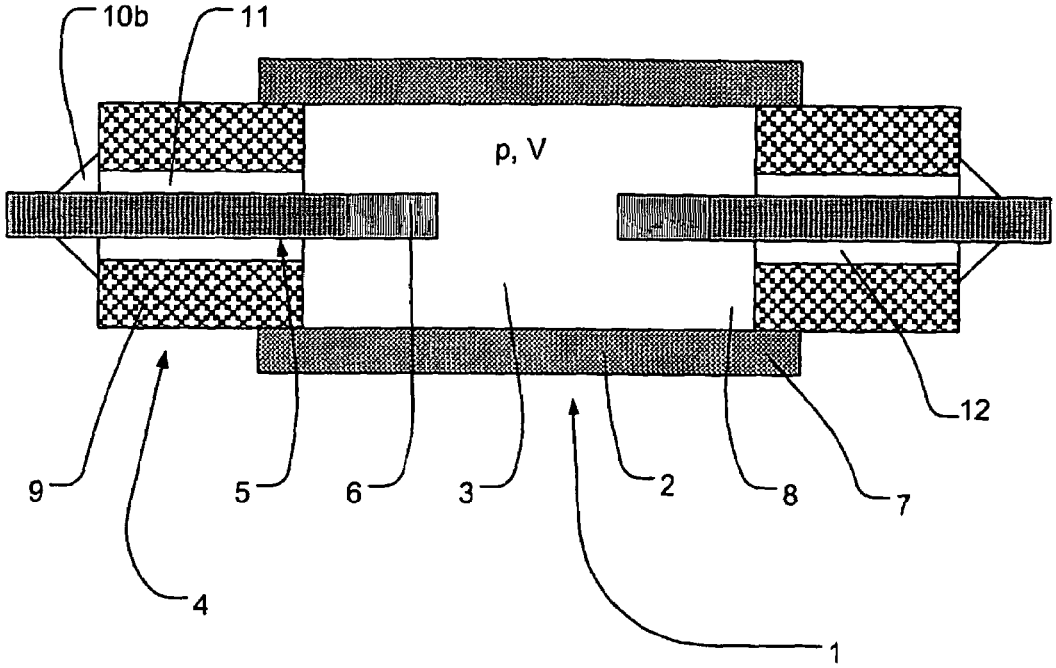
Figure 3:
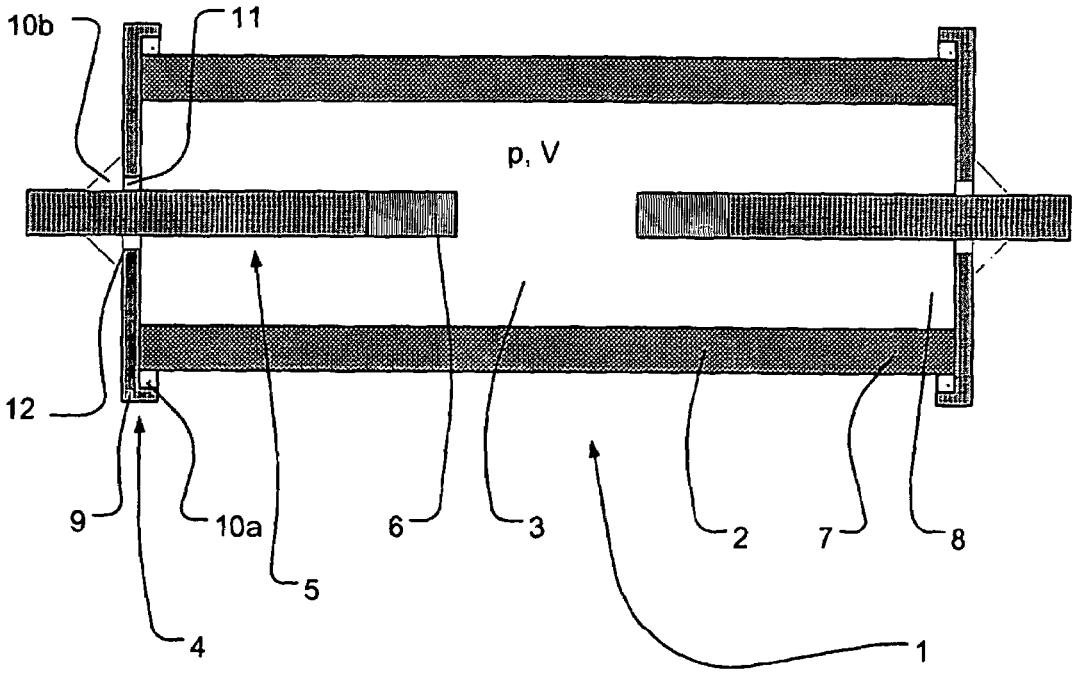
Figure 4:
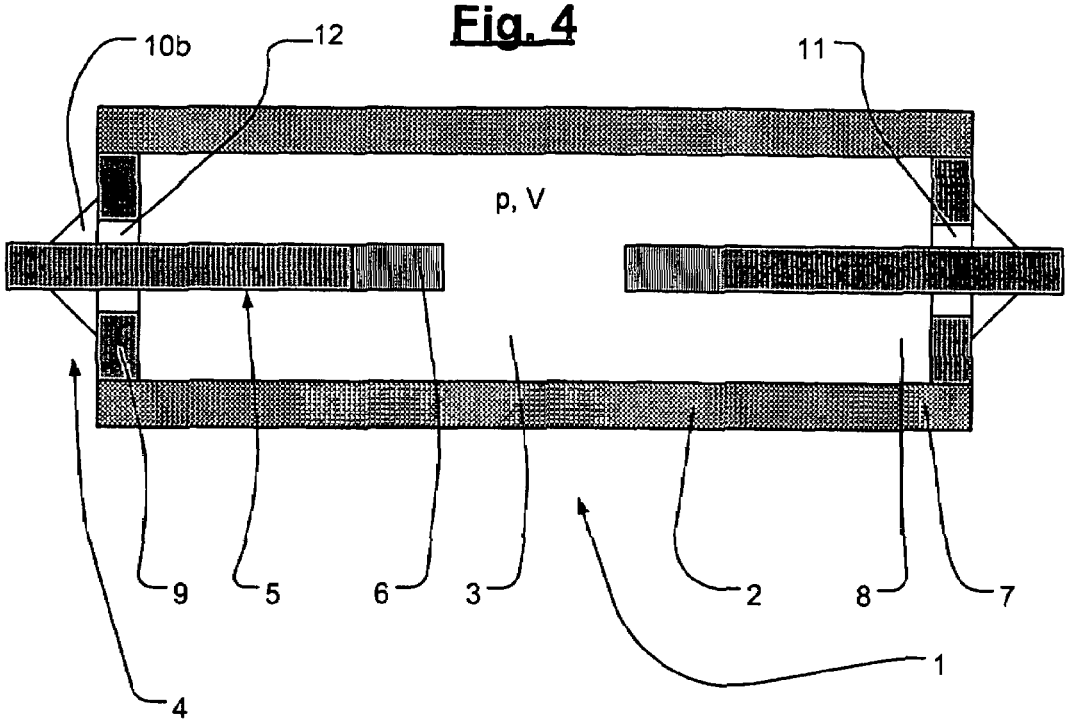
Figure 5:
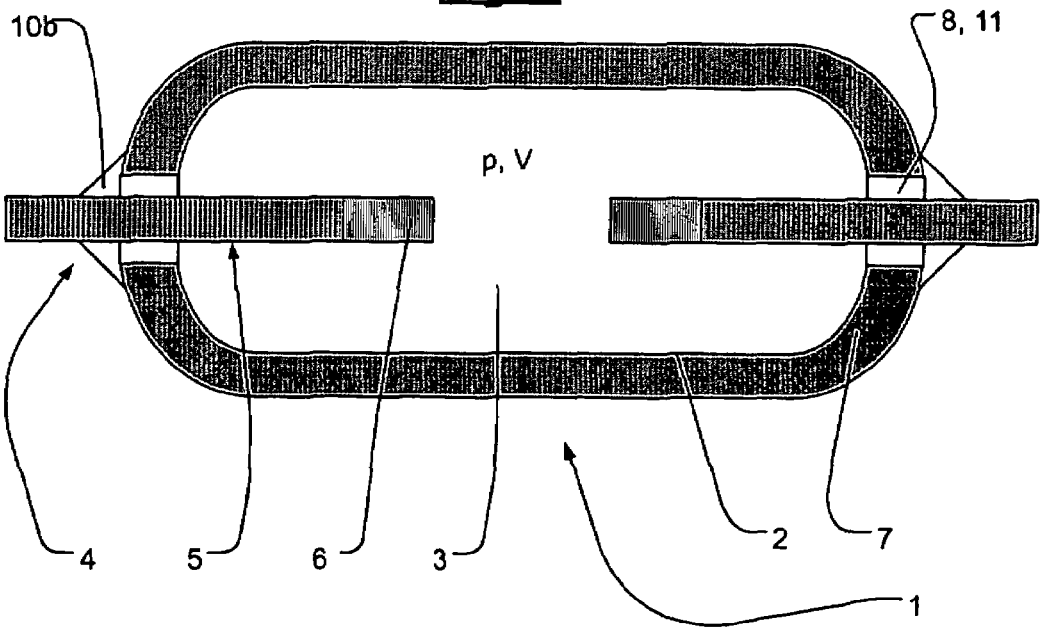
Figure 6:
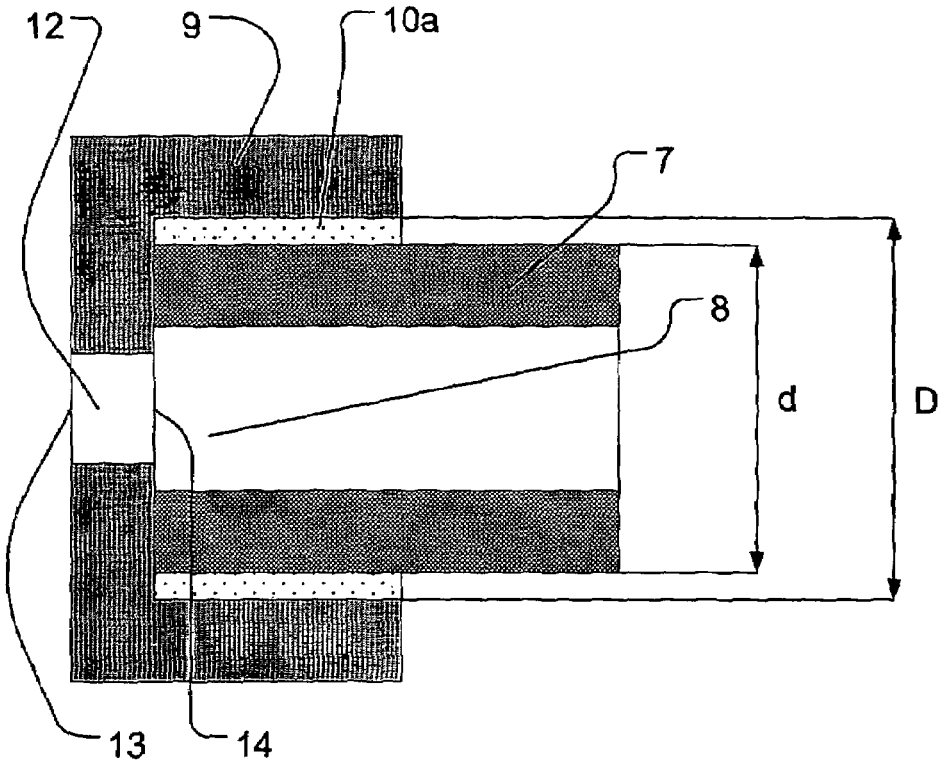
Figure 7:
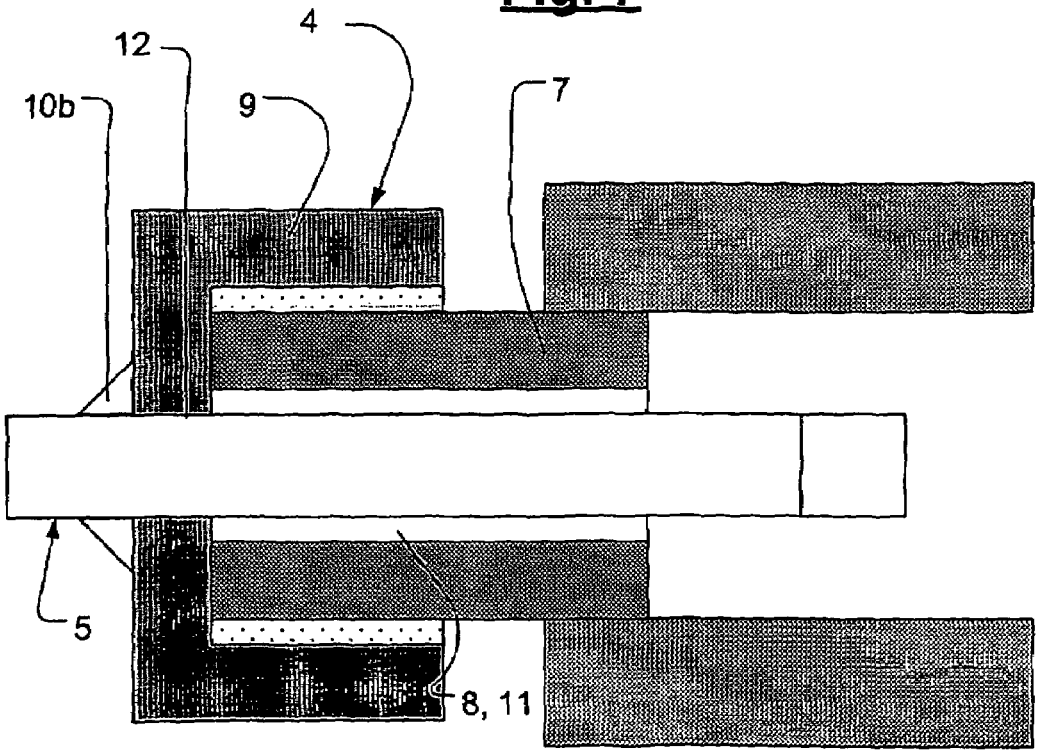
Figure 8:
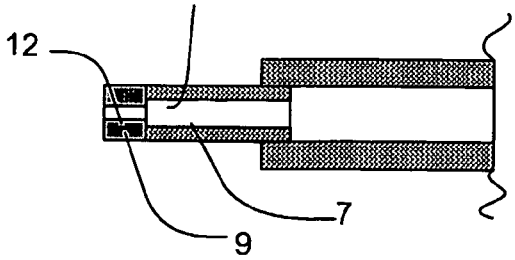
Figure 10:
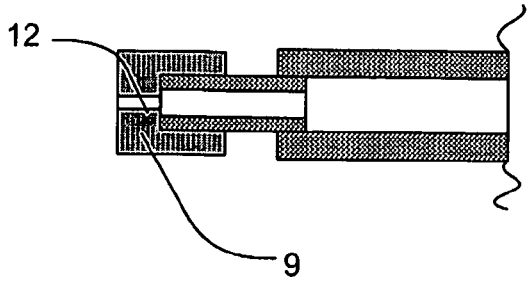
Figure 9:
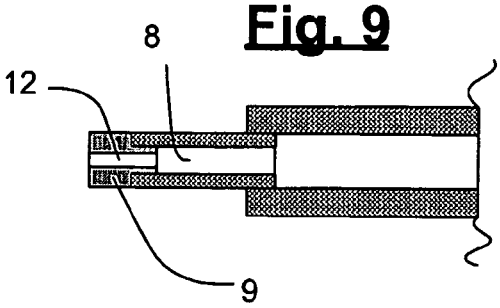
Figure 11:
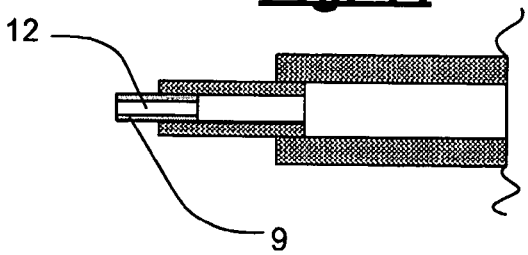

The invention will be further illustrated by FIGS. 1 to 11:

FIG. 1 shows a cross-section of a first ceramic gas tight high-pressure burner along its longitudinal axis, FIG. 2 shows a cross-section of a second ceramic gas tight high-pressure burner along its longitudinal axis, FIG. 3 shows a cross-section of a third ceramic gas tight high-pressure burner along its longitudinal axis, FIG. 4 shows a cross-section of a fourth ceramic gas tight high-pressure burner along its longitudinal axis, FIG. 5 shows a cross-section of a fifth ceramic gas tight high-pressure burner along its longitudinal axis, FIG. 6 shows a detailed cross-section of an end closure device connected to a discharge vessel without feed-through, FIG. 7 shows a detailed cross-section of an end closure device connected to a discharge vessel and to a feed-through, FIG. 8 shows the cross-section of a first end-closure member profile, FIG. 9 shows the cross-section of a second end-closure member profile, FIG. 10 shows the cross-section of a third end-closure member profile, and FIG. 11 shows the cross-section of a fourth end-closure member profile.

FIG. 1 shows a first ceramic gas tight high-pressure burner 1 having a discharge vessel 2 with a discharge cavity 3, two end closure devices 4 and two feed-through 5 each with an electrode 6. The discharge vessel 2 is made of three parts, a sealant, acting like a first connection means 10*a*, located between the end part 7 of the discharge vessel 2 and the cap-shaped end closure member 9, a cap-shaped end closure member 9, and a laser welding seam, acting like a second connection means 10*b*, connecting the end closure member 9 and the feed-through 5, whereby the central part of the discharge vessel 2 forms the discharge cavity 3, and the two remaining peripheral parts form end parts 7 with an end opening 8. Said end parts 7 with the end openings 8 form a tube. Said tubular end parts 7 and consequently the two end openings 8 are located at opposite sides of the discharge vessel 2. In order to get a ceramic gas tight burner 1, each end opening 8 is gas tight closed by a corresponding end closure device 4. The end closure device 4 comprises an end closure member 9 and connection means 10*a*, 10*b*. Said end closure device 4, more precisely said end closure member 9 of the end closure device 4, is connected to the discharge vessel 2, or more precisely to the end part 7 of the discharge vessel 2, by a first connection means 10*a*. Said end closure device 4 has a feed-through opening to arrange a feed-through 5 therein. The feed-through 5 is gas tight connected to the end closure device 4 by a second connection means 10*b*, so that a ceramic gas tight high-pressure burner 1 with a volume V and an internal gas pressure p at room temperature is obtained.

FIG. 2 shows a second ceramic gas tight high-pressure burner 1 having a discharge vessel 2 with a discharge cavity 3, two end closure devices 4 and two feed-through 5 each with an electrode 6. The discharge vessel 2 is a one-part tubular discharge vessel 2 with a discharge cavity 3 and two tubular end parts 7, each with an end opening 8. Said tubular end parts 7 and consequently the two end openings 8 are located at opposite sides of the discharge vessel 2. In order to get a gas tight burner 1, each end opening 8 is gas tight closed by a corresponding end closure device 4. The end closure device 4 comprises one end closure member 9 and connection means 10*b*. Said end closure device 4, more precisely said end closure member 9 of the end closure device 4 is connected to the discharge vessel 2, or more precisely to the end part 7 of the discharge vessel 2 without first connection means, i.e. by sintering. Said end closure member 4 fits into the end opening 8. Said end closure device 4 has a feed-through opening into which a feed-through 5 arranged. The feed-through 5 is gas tight connected to the end closure device 4 by a second connection means 10*b*, so that a ceramic gas tight high-pressure burner 1 with a volume V and an internal gas pressure p is obtained. Due to manufacturing tolerances, there is a small gap between the feed-through 5 and the feed-through opening 12 of the end closure device 4 called crevice 11.

In FIG. 3 a third ceramic gas tight high-pressure burner 1 is shown. The burner configuration is similar to that shown in FIG. 1. Compared to FIG. 1, the discharge vessel 2 shown in FIG. 3 is a one-part discharge vessel 2, shaped as a tube with a discharge cavity 3 and tubular end parts 7 having end openings 8. Each opening 8 is covered by and connected to an end closure device 4. Said end closure device 4, having a feed-through opening that arranges a feed-through 5 with an electrode 6 therein, comprises an end closure member 9 and connection means 10*a*, 10*b*. Said end closure member 9 completely covers said end opening 8 and partly surrounds said end part 7 of the discharge vessel 2. The end closure member 9 is gas tight connected to the discharge vessel 2 by first connection means 10*a*, which could be a sealant or any other connection means, with an expansion coefficient similar to the one of the discharge vessel, and able to withstand higher temperatures and corrosion. The first connection means 10*a* is located between the end closure member 9 and the end part 7 of the discharge vessel 2. The feed-through 5 is also gas tight connected to the end closure member 9 by second connection means 10*b*, whereby the feed-through 5 is arranged in the feed-through opening 12 of the end closure device 4. The crevice 11 of the end closure device 4 according to FIG. 3 has a much smaller volume compared to the crevice of the end closure device shown in FIG. 1 and the connection means 10*b* for connecting the feed-through 5 to the end closure member 9 are located closer to the electrode 6. Thus the crevice 11 is practically reduced to 0. Connection means 10*b* fills the crevice 11 during connecting step.

In FIG. 4 a fourth ceramic gas tight high-pressure burner 1 is shown. The ceramic gas tight high-pressure burner has an end closure device 4. Said end closure device 4 is similar to the end closure device shown in FIG. 2, except the end closure member 9 is much shorter than the end closure member shown in FIG. 2 and therefore the crevice 11 has a smaller volume, ideally the crevice is completely filled with the second connection means 10*b*.

FIG. 5 shows a fifth ceramic gas tight high-pressure burner 1, shaped by slip casting, which end closure device 4 has no end closure member but one connection means 10*b*. The feed-through 5 is directly gas tight connected to the discharge vessel 2 by the second connection means 10*b*, forming a crevice 11 along the end opening 8.

In FIG. 6 the connection of the end closure member 9 to the end part 7 of the discharge vessel is shown in detail. The end part 7, containing the end opening 8, is tubular shaped with an outer diameter d. The end closure member 9 is shaped as a cap with an inner diameter D, which is slightly larger than the outer diameter d of the end part 7 of the discharge vessel. The end closure member 9, shaped as an end cap, having a centered feed-through opening 12, with an outer cross-section 13 and an inner cross section 14, covers the end part 7 in such a way that the end closure member 9 at least partly surrounds the end part 7. Between the end part 7 and the end closure member 9 a small clearance can be observed in axial direction. In this clearance the first connection means 10*a* is located.

FIG. 7 shows the connection of the end closure device shown in FIG. 6 with the feed-through 5. In FIG. 7 a feed-through 5 is arranged in the feed-through opening 12 of the end closure device 4. The feed-through is gas tight connected to the end closure member 9 of the end closure device 4 by the second connection means 10*b*. In this figure, the connection is realised by laser welding, so the second connection means 10*b*is a welding seam. Between the feed-through 5 and the end part 7 of the discharge vessel a small gap can be observed. This gap forms a crevice 11 along the end opening 8 of the end part 7.

In FIG. 8 to 11 different end closure member shapes are shown.

FIG. 8 shows an end closure member 9 having a disc-like shape with a feed-through opening 12 susceptible to arrange a feed-through therein. The end closure member 9 has an outer diameter that is as large as the outer diameter of the tubular end part 7, so that the end opening 8 is completely covered by the end closure member 9, except the part covered by the feed-through opening 12.

FIG. 9 shows an end closure member 9 having a cork-like shape with a feed-through opening 12 susceptible to arrange a feed-through therein. The end closure member 9 has two tubular areas with different outer diameters, whereby the tubular area with the smaller outer diameter fits into the end opening 8.

FIG. 10 shows an end closure member 9 having a cap-like shape with a feed-through opening 12 susceptible to arrange a feed-through therein. The end closure member 9 has two areas, one tubular area and one bottom area. The tubular area has an inner diameter susceptible to cover at least partly the end part of the discharge vessel.

FIG. 11 shows an end closure member 9 having a tubular shape with a feed-through opening 12 for arranging a feed-through therein. The outer diameter of the end closure member 9 is susceptible to fit into the end part of the discharge vessel.

List of reference numbers

| | |
|---|---|
| 1 | Burner |
| 2 | Discharge vessel |
| 3 | Discharge cavity |
| 4 | End closure device |
| 5 | Feed-through |
| 6 | Electrode |
| 7 | End part |
| 8 | End opening |
| 9 | End closure member |
| 10 | Connection means |
| 10a | First connection means |
| 10b | Second connection means |
| 11 | Crevice |
| 12 | Feed-through opening |
| 13 | Outer cross-section of the feed-through opening |
| 14 | Inner cross-section of the feed-through opening |

We claim:

1. A ceramic gas tight high-pressure burner comprising: an ionizable filling, a discharge vessel having a discharge cavity with a volume from 3 $mm^3$ to 30 $mm^3$, whereby the internal filling pressure of the discharge cavity is ≧0.1 MPa, at room temperature, at least one end closure device at at least one end of the discharge vessel, the at least one end closure device having a feed-through opening and forming a crevice, and at least one feed-through passing through the feed-through opening, wherein the crevice is between the at least one feed-through and the discharge vessel, and wherein the crevice is tubular-shaped and has a volume of >0 $mm^3$ and ≦1.7$mm^3$, and wherein the crevice has an open end facing the discharge vessel.

2. The ceramic gas tight high-pressure burner according to claims 1, further comprising at least one connection means for gas tight connecting the feed-through to the discharge vessel.

3. The ceramic gas tight high-pressure burner according to claim 2, wherein said connection means is selected from a group comprising a sealant and a welding seam.

4. The ceramic gas tight high-pressure burner according to claim 1, wherein an outer cross-section of the feed-through opening is equal or greater than an inner cross-section of the feed-through opening, and wherein the feed-through opening has a shape of at least one of a cylinder, a cone, an ellipsoid, a parabola, a hyperbola, a hemisphere, and a T-shape.

5. The ceramic gas tight high-pressure burner according to claim 1, wherein the at least one end closure device comprises a cermet material having a gradient.

6. The ceramic gas tight high-pressure burner according to claim 1, wherein at least one end part of the discharge vessel is at least partly coated with a layer that improves connecting means bonding strength, whereby the layer is at least partly located between an end part of the discharge vessel and the at least one end closure device.

7. A method of manufacturing a ceramic gas tight high-pressure burner (1) comprising:

a) at least one end closure device, b) at least two feed-through members, and c) at least one discharge vessel with at least one end opening, whereby the manufacturing method comprises the acts of:

i) filling said discharge vessel with an ionizable filling through at least one opening, and ii) closing said at least one end opening by arranging a feed- through in said opening followed by gas tight connecting said feed- through to the end closure device and/or to the discharge vessel, wherein a crevice is formed between the feed-through and the at least one discharge vessel, wherein the crevice is tubular-shaped and has a volume of >0 $mm^3$ and ≦1.7 $mm^3$, and wherein the crevice has an open end facing the discharge vessel.

8. The method of claim 7, wherein an outer cross-section of said at least one end opening is equal or greater than an inner cross-section of said at least one end opening.

9. A high-pressure burner comprising: a discharge vessel including an ionizable filling; an end closure device located at an end of the discharge vessel, the end closure device having a feed-through opening; and a feed-through passing through the feed-through opening, wherein a crevice is formed between the feed-through and the discharge vessel, wherein the crevice is tubular-shaped and has a volume of >0 $mm^3$ and ≦1.7 $mm^3$, and wherein the crevice has an open end facing the discharge vessel.

10. The ceramic gas tight high-pressure burner of claim 1, wherein the at least one end closure device is configured to fit in the discharge vessel.

11. The high-pressure burner of claim 9, wherein the end closure device is configured to fit on the discharge vessel.

12. The high-pressure burner of claim 9, further comprising an end part configured to fit into the discharge vessel, wherein the end closure device is configured to fit on the end part.

* * * * *